US009759040B2

(12) United States Patent
Nguyen et al.

(10) Patent No.: US 9,759,040 B2
(45) Date of Patent: Sep. 12, 2017

(54) AUTONOMOUS SELECTIVE SHIFTING TOOL

(71) Applicant: WEATHERFORD/LAMB, INC., Houston, TX (US)

(72) Inventors: Minh-Tuan Nguyen, Houston, TX (US); Gary D. Ingram, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 300 days.

(21) Appl. No.: 14/573,501

(22) Filed: Dec. 17, 2014

(65) Prior Publication Data

US 2015/0176369 A1 Jun. 25, 2015

Related U.S. Application Data

(60) Provisional application No. 61/919,324, filed on Dec. 20, 2013.

(51) Int. Cl.

| | |
|---|---|
| ***E21B 34/14*** | (2006.01) |
| ***E21B 43/26*** | (2006.01) |
| ***E21B 34/06*** | (2006.01) |
| ***E21B 47/09*** | (2012.01) |
| ***E21B 23/02*** | (2006.01) |
| ***E21B 43/14*** | (2006.01) |
| *E21B 34/00* | (2006.01) |

(52) U.S. Cl.

CPC ..... *E21B 34/066* (2013.01); *E21B 23/02* (2013.01); *E21B 34/14* (2013.01); *E21B 43/14* (2013.01); *E21B 43/26* (2013.01); *E21B 47/09* (2013.01); *E21B 2034/007* (2013.01)

(58) Field of Classification Search

CPC ..... E21B 34/066; E21B 34/14; E21B 43/126; E21B 43/26; E21B 47/09; E21B 47/124

USPC ..... 166/66.6, 66.7, 373, 53, 385, 334.4, 166/334.1

See application file for complete search history.

(56) References Cited

U.S. PATENT DOCUMENTS 3,419,075 A * 12/1968 Brown ..... E21B 23/08 137/625.12

4,192,380 A 3/1980 Smith (Continued)

OTHER PUBLICATIONS

PCT International Search Report and Written Opinion dated Mar. 31, 2015.

*Primary Examiner* — Kenneth L Thompson

(74) *Attorney, Agent, or Firm* — Patterson + Sheridan, LLP

(57) ABSTRACT

A system for fracturing a hydrocarbon bearing formation includes a valve including a tubular housing having a bore therethrough and one or more flow ports formed through a wall thereof. One or more locator tags are embedded in the housing, and a sleeve is disposed in the housing and movable relative thereto between an open and a closed position. The system also includes a shifting tool comprising a shifter movable between an extended position and a retracted position and operable to engage the valve sleeve. The shifting tool includes a lock that keeps the shifter extended in the locked position and allows the shifter to retract in the unlocked position. The shifting tool also includes an antenna for detecting the locator tags, and an electronics package in communication with the antenna and the actuator for operating the actuator in response to detection of the locator tags.

19 Claims, 13 Drawing Sheets

(56) References Cited

U.S. PATENT DOCUMENTS

| | | | | |
|---|---|---|---|---|
| 5,355,953 | A * | 10/1994 | Shy | E21B 34/14 166/128 |
| 6,333,699 | B1 | 12/2001 | Zierolf | |
| 7,063,148 | B2 | 6/2006 | Jabusch | |
| 7,150,318 | B2 * | 12/2006 | Freeman | E21B 34/14 166/255.1 |
| 7,387,165 | B2 | 6/2008 | Lopez de Cardenas et al. | |
| 7,878,242 | B2 | 2/2011 | Gray | |
| 8,276,674 | B2 * | 10/2012 | Lopez de Cardenas | E21B 34/06 166/318 |
| 8,459,365 | B1 * | 6/2013 | Schultz | E21B 34/14 166/332.4 |
| 8,479,808 | B2 | 7/2013 | Gouthaman | |
| 8,505,632 | B2 | 8/2013 | Guerrero et al. | |
| 8,857,516 | B2 * | 10/2014 | Ganguly | E21B 43/26 166/177.5 |
| 9,133,671 | B2 * | 9/2015 | Kellner | E21B 23/00 |
| 2008/0083533 | A1 * | 4/2008 | Malone | E21B 47/00 166/254.2 |
| 2009/0044944 | A1 | 2/2009 | Murray et al. | |
| 2009/0294124 | A1 | 12/2009 | Patel | |
| 2012/0067594 | A1 | 3/2012 | Noske et al. | |
| 2014/0034310 | A1 | 2/2014 | Andersen | |
| 2014/0174761 | A1 * | 6/2014 | Spencer | E21B 23/02 166/381 |
| 2014/0251612 | A1 | 9/2014 | Powers | |
| 2014/0305662 | A1 | 10/2014 | Giroux et al. | |
| 2014/0352944 | A1 | 12/2014 | Devarajan et al. | |
| 2015/0361761 | A1 * | 12/2015 | Lafferty | E21B 23/14 166/250.01 |

* cited by examiner

AUTONOMOUS SELECTIVE SHIFTING TOOL

CROSS-REFERENCE TO RELATED APPLICATIONS

This application claims benefit of U.S. Provisional Patent Application Ser. No. 61/919,324, filed Dec. 20, 2013, which is herein incorporated by reference.

BACKGROUND OF THE INVENTION

Field of the Invention

Embodiments of the invention generally relate to an autonomous selective shifting tool.

Description of the Related Art

Hydraulic fracturing (aka fracing or fracking) is an operation for stimulating a subterranean formation to increase production of formation fluid, such as crude oil and/or natural gas. A fracturing fluid, such as a slurry of proppant (i.e., sand), water, and chemical additives, is pumped into the wellbore to initiate and propagate fractures in the formation, thereby providing flow channels to facilitate movement of the formation fluid into the wellbore. The fracturing fluid is injected into the wellbore under sufficient pressure to penetrate and open the channels in the formation. The fracturing fluid injection also deposits the proppant in the open channels to prevent closure of the channels once the injection pressure has been relieved. Typically, a wellbore will intersect several hydrocarbon-bearing production zones. Each zone may have a different fracture pressure. To ensure that each zone is treated, each zone is treated separately while isolating a previously treated zone from the next zone to be treated using a frac plug.

SUMMARY OF THE INVENTION

In one embodiment, a system for fracturing a zone of a hydrocarbon bearing formation includes a valve. The valve includes a tubular housing for assembly as part of a string of tubulars and having a bore therethrough and one or more flow ports formed through a wall thereof. One or more locator tags are embedded in the housing, and a sleeve is disposed in the housing and longitudinally movable relative thereto between an open position and a closed position. The sleeve seals the ports from the bore in the closed position and exposes the ports to the bore in the open position. The system also includes a shifting tool for deployment through the tubular string, and comprises a shifter movable between an extended position and a retracted position and operable to engage the valve sleeve in the extended position and pass through the valve sleeve in the retracted position. The shifting tool also includes a lock movable between a locked position and an unlocked position, the lock keeping the shifter extended in the locked position and allowing the shifter to retract in the unlocked position. An actuator is connected to the lock and operable to at least move the lock from the unlocked position to the locked position. The shifting tool also includes an antenna for detecting the locator tags, an electronics package in communication with the antenna and the actuator for operating the actuator in response to detection of the locator tags, and a work line rope socket connected to the electronics package and the antenna.

In another embodiment, a system for use in a wellbore includes a shifting tool for deployment through a tubular string having one or more locator tags embedded therein.

The shifting tool includes: a shifter movable between an extended position and a retracted position; a lock movable between a locked position and an unlocked position, the lock keeping the shifter extended in the locked position and allowing the shifter to retract in the unlocked position; an actuator connected to the lock and operable to at least move the lock from the unlocked position to the locked position; an antenna for detecting the locator tags; and an electronics package in communication with the antenna and the actuator for operating the actuator in response to detection of the locator tags. The system further includes a tractor for driving the shifting tool through the tubular string and connectable to the electronics package for operation of the tractor by the electronics package.

In another embodiment, a method for fracturing one or more zones of a hydrocarbon bearing formation includes: programming a shifting tool to selectively open one or more valves of a tubular string set in the wellbore; deploying the shifting tool through the tubular string using a work line; and during deployment: detecting an unselected valve by the shifting tool; passing through the unselected valve; detecting the selected valve by the shifting tool, wherein the shifting tool actuates to a locked position in response to detection of the selected valve; and opening the selected valve by the locked shifting tool.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

To facilitate understanding, identical reference numerals have been used, where possible, to designate identical elements that are common to the figures. It is contemplated that elements disclosed in one embodiment may be beneficially utilized on other embodiments without specific recitation.

DETAILED DESCRIPTION

Figure 1:
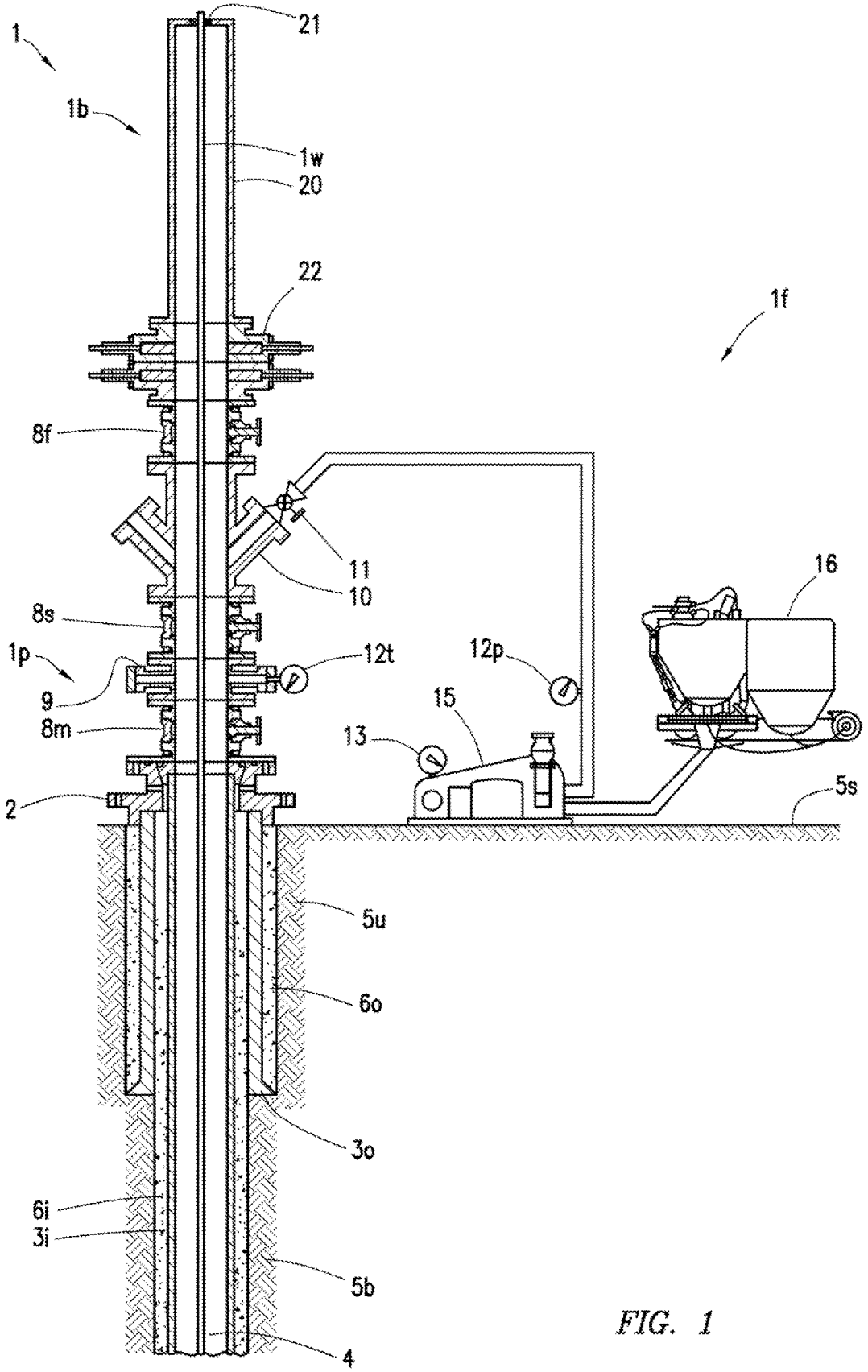
FIG. 1 illustrates a system, according to one embodiment of the present invention.
Figure 2A:
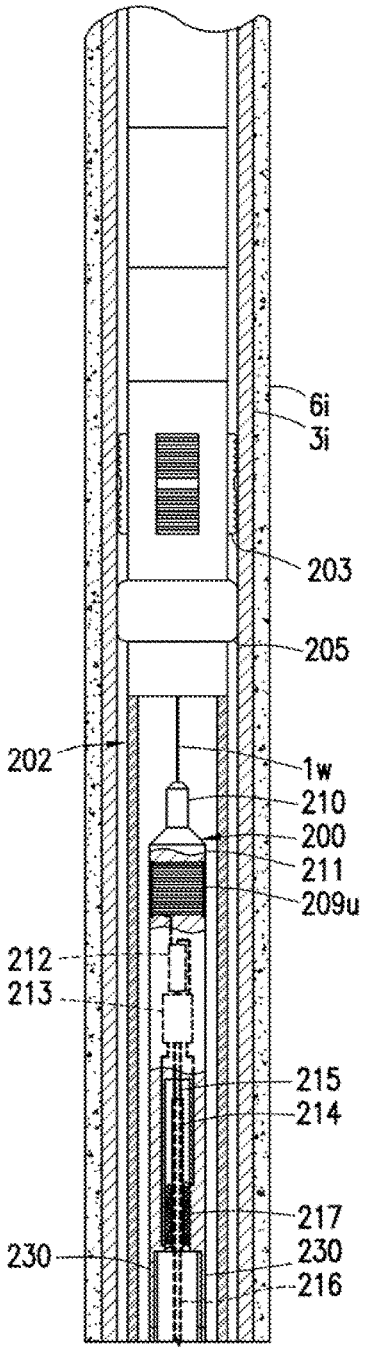
FIGS. 2A-2F illustrate a shifting tool traveling downhole through a first fracture valve in a pass-through mode.
Figure 2B:
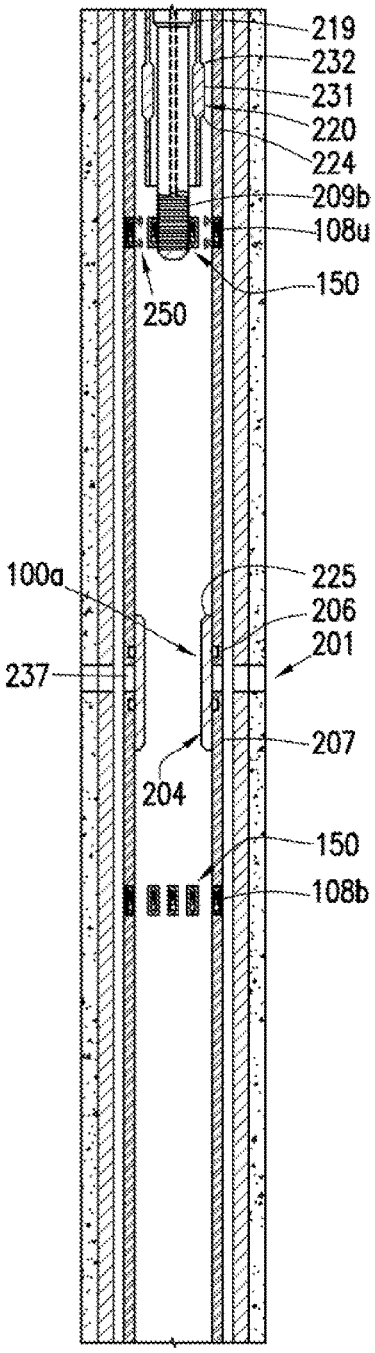
Figure 2C:
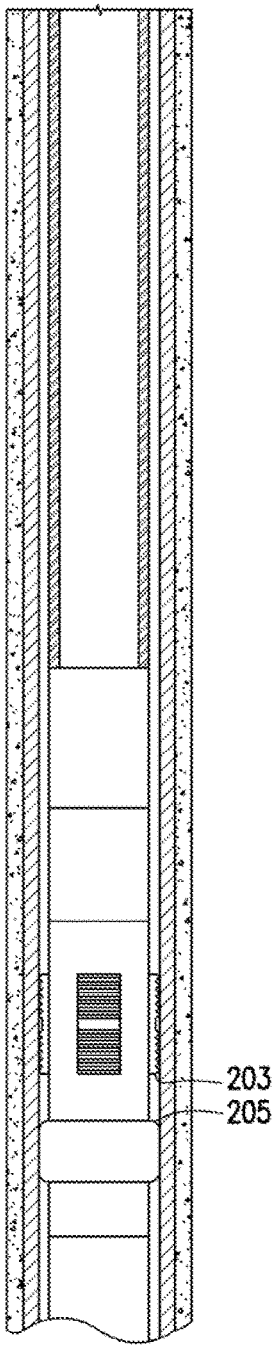
Figure 2D:
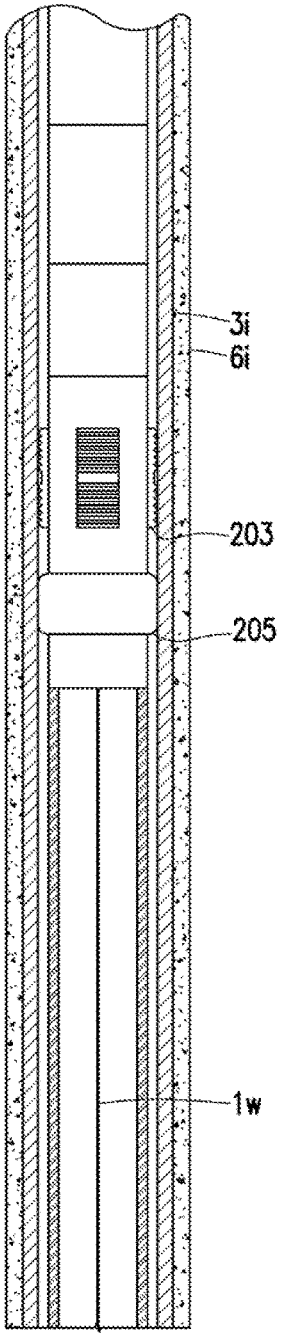
Figure 2E:
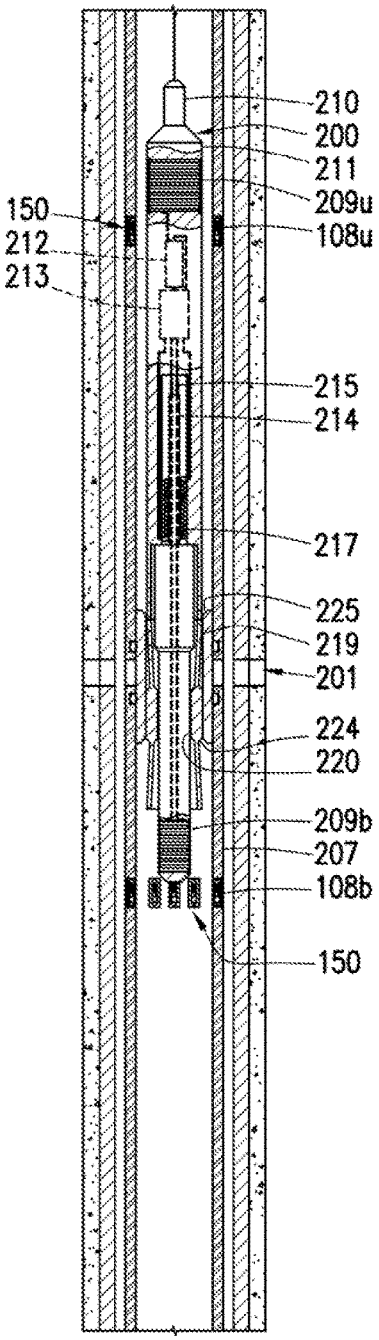
Figure 2F:
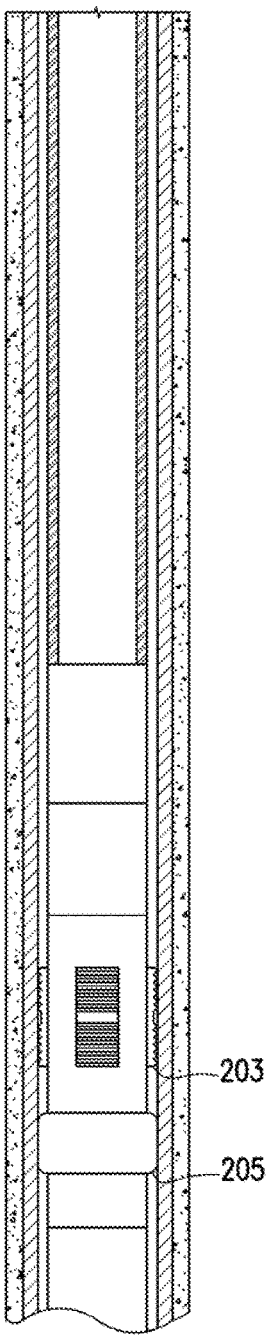

FIGS. 1 illustrates a system 1, according to one embodiment of the present invention. The system 1 may include a lubricator 1*b*, a fluid system 1*f*, a production tree 1*p*, and a work line 1*w*, such as slick line or wire rope. A wellhead 2 may be mounted on an outer casing string 3*o* which has been deployed into a wellbore 4 drilled from a surface 5*s* of the earth and cemented 6*o* into the wellbore 4. An inner casing string 3*i* has been deployed into the wellbore 4, hung from the wellhead 2, and cemented 6*i* into place. The outer casing string 3*o* may extend to a depth adjacent a bottom of an upper formation 5*u* and the inner casing string 3*i* may extend through a lower formation 5*b*. The upper formation 5*u* may be non-productive and the lower formation 5*b* may be a hydrocarbon-bearing reservoir having one or more production zones (not shown). Alternatively, although shown as vertical, the wellbore 4 may include a vertical portion and a deviated portion, such as a horizontal portion.

The production tree 1*p* may be installed on the wellhead 2. The production tree 1*p* may include a master valve 8*m*, a flow cross 9, and a swab valve 8*s*. Each component of the production tree 1*p* may be connected together, the production tree may be connected to the wellhead 2 and an injector head 10, and the lubricator 1*b* may be connected to the injector head, such as by flanges and studs or bolts and nuts.

The fluid system 1*f* may include the injector head 10, shutoff valve 11, one or more gauges, such as the pressure gauges 12*p,t* and a stroke counter 13, a fracture pump 15, and a fracture fluid mixer, such as a recirculating mixer 16. The pressure gauge 12*t* may be connected to the flow cross 9 and may be operable to monitor wellhead pressure. The pressure gauge 12*p* may be connected between the fracture pump 15 and the valve 11 and may be operable to measure discharge pressure of the fracture pump 15. The stroke counter 13 may be operable to measure a flow rate of the fracture pump 15. Alternatively, the stroke counter 13 and the pressure gauges 12*p,t* may be sensors in data communication with a programmable logic controller (PLC) (not shown) for automated or semi-automated control of the fracturing operation.

The lubricator 1*b* may include a tool housing 20 (aka lubricator riser), a seal head 21, one or more blowout preventers 22, and the shutoff valve 8*f*. Components of the lubricator 1*b* may be connected, such as by flanged connections. The shutoff valve 8*f* may also have a lower flange for connecting to an upper flange of the injector head 10. The seal head 21 may include a stuffing box and a grease injector. The stuffing box may include a packing, a piston, and a housing. A port may be formed through the housing in communication with the piston. The port may be connected to a hydraulic power unit (not shown) of a service truck (not shown) via a hydraulic conduit (not shown). When operated by hydraulic fluid, the piston may longitudinally compress the packing, thereby radially expanding the packing inward into engagement with the work line 1*w*.

The grease injector may include a housing integral with the stuffing box housing and one or more seal tubes. Each seal tube may have an inner diameter slightly larger than an outer diameter of the work line 1*w*, thereby serving as a controlled gap seal. An inlet port and an outlet port may be formed through the grease injector/stuffing box housing. A grease conduit (not shown) may connect an outlet of a grease pump (of the service truck) with the inlet port and another grease conduit (not shown) may connect the outlet port with a grease reservoir. Grease (not shown) may be injected from the grease pump into the inlet port and along the slight clearance formed between the seal tube and the work line 1*w* to lubricate the work line 1*w*, reduce pressure load on the stuffing box packing, and increase service life of the stuffing box packing.

FIGS. 2A-2F illustrate a shifting tool 200 traveling through a first fracture valve 100*a* in a pass-through mode. Once the inner casing string 3*i* has been installed into the wellbore 4, a work string (not shown) having a plurality of perforation guns may be deployed into the inner casing string until the perforation guns are located adjacent to respective hydrocarbon-bearing production zones of the lower formation 5*b*. The guns may be fired, thereby forming perforations 201 through the inner casing string 3*i* adjacent to the respective zones. A production valve string 202 may then be deployed into the inner casing string 3*i*. The production valve string 202 may include a hanger 203, a packer 205, and a fracture valve 100*a,b* (100*b* in FIG. 3B) for each of the zones. Once the production valve string 202 has been deployed adjacent to the respective zones, the hangers and packers may be set against the inner casing string, thereby supporting the production valve string 202 and isolating the zones.

Each fracture valve 100*a,b* may include a tubular housing 207 having flow ports 237 formed through a wall thereof and a respective sleeve 204 disposed in the housing and longitudinally movable relative thereto between an open position (FIGS. 3D-3F) and a closed position (shown). Each fracture valve 100*a,b* may include a pair of seals 206, such as o-rings, straddling the ports 237 when the respective sleeve 204 is in the closed position, thereby isolating the ports from a bore of the production valve string 202. Movement of each sleeve 204 to the open position may expose the respective ports 237 to the valve string bore, thereby providing access to the respective zone for fracturing and/or production.

Each fracture valve 100*a,b* may also include one or more sets 108*u,b*, 208*u,b* of locators, each set having one or more locators. An exemplary locator is a radio frequency identification (RFID) tag 150, which may be embedded in the respective housing 207. Each set 108*u,b*, 208*u,b* of RFID tags 150 may be mounted in an inner surface of the respective housing 207 and encased by an engineering polymer or another non-conductive or non-magnetic material. Each valve 100*a,b* may include a respective upper set 108*u*, 208*u* of RFID tags 150 located along the respective housing 207 above the respective ports thereof and a respective lower set 108*b*, 208*b* of RFID tags 150 located along the respective housing below the respective ports thereof. Each RFID tag 150 may be encoded with an address of the respective fracture valve 100*a,b* such that, when activated, each RFID tag 208 may respond by emitting a signal 250 communicating the address to an antenna 209*u*, 209*b* embedded within the shifting tool 200. Additionally, each RFID tag 150 may be encoded with the location thereof in the respective fracture valve 100*a,b* (whether it is in the respective upper 108*u*, 208*u* or lower 108*b*, 208*b* set). The sets 108*u,b*, 208*u,b* of RFID tags 150 of the respective valves 100*a,b* may be spaced apart by a distance corresponding to a length of the shifting tool 200.

The shifting tool 200 may be lowered into the wellbore 4, through the inner casing string 3*i*, and into the production valve string 202 using the work line 1*w*. The shifting tool 200 is coupled to the work line 1*w* via a work line rope socket 210 disposed at an upper end of a tubular housing 211 of the shifting tool 200. One or more RFID antennas 209*u*, 209*b* are disposed within the shifting tool 200. A first antenna 209*u* is disposed at an upper end of the tubular housing 211 and a second antenna 209*b* is disposed at a lower end of a collet locking mandrel 219. Each of the antennas 209*a*, 209*b* is coupled to a battery 212 and electronics package 213 for powering the antennas 209*a*, 209*b* and processing signals 250 received by the antennas 209*a*, 209*b* from the RFID tags of the fracture valves 100*a,b*. Each of the antennas 209*a*, 209*b*, as well as the battery 212 and the electronics package 213, are disposed within the tubular housing 211.

Alternatively, the shifting tool 200 may have only a single antenna and/or the fracture valves may have only one set of tags.

Figure 3A:
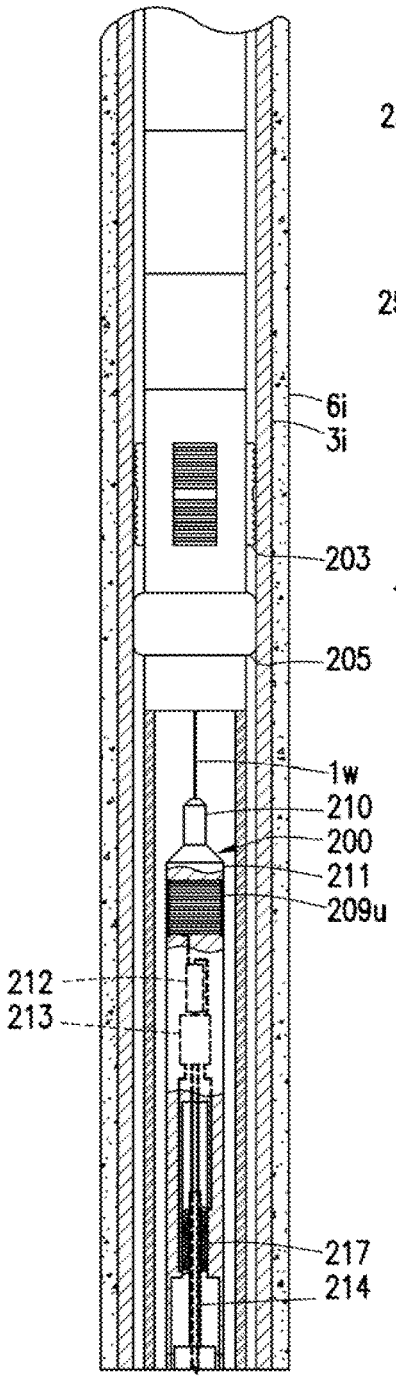
FIGS. 3A-3I illustrate the shifting tool opening a second fracture valve.
Figure 3B:
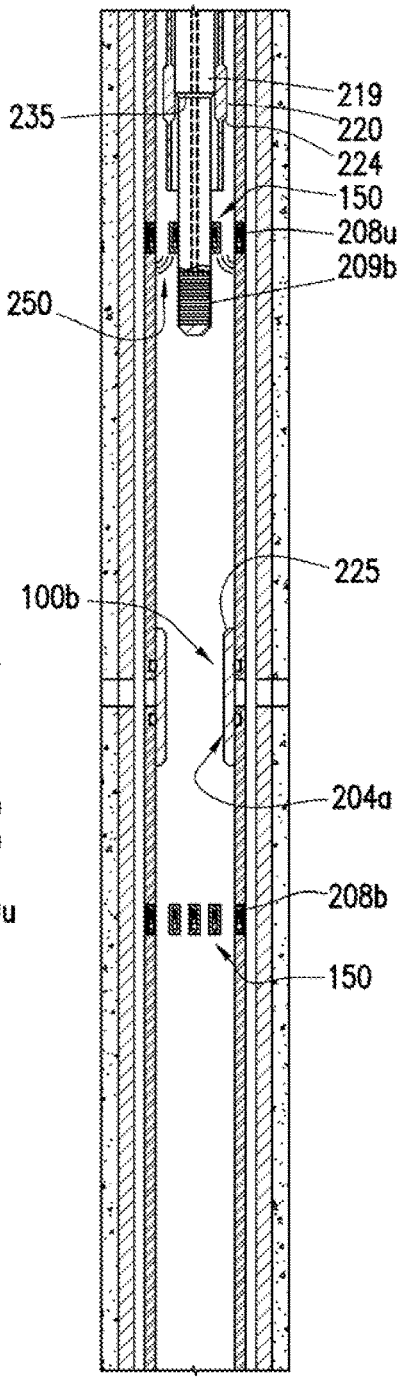
Figure 3C:
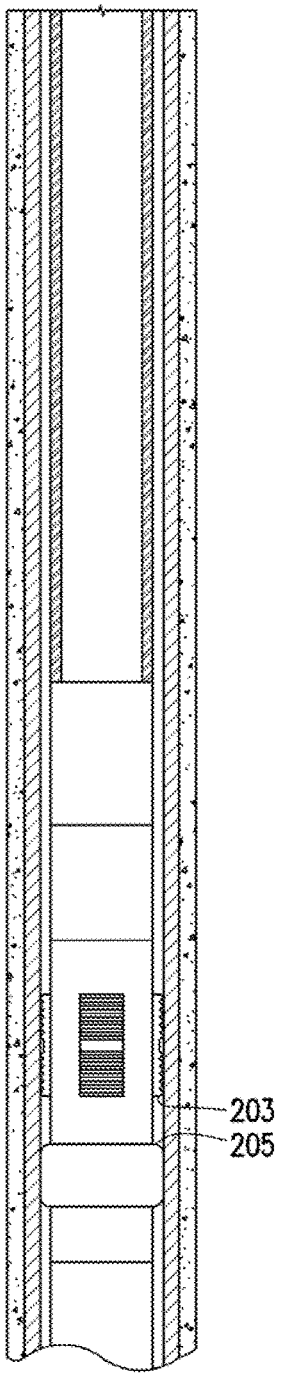
Figure 3D:
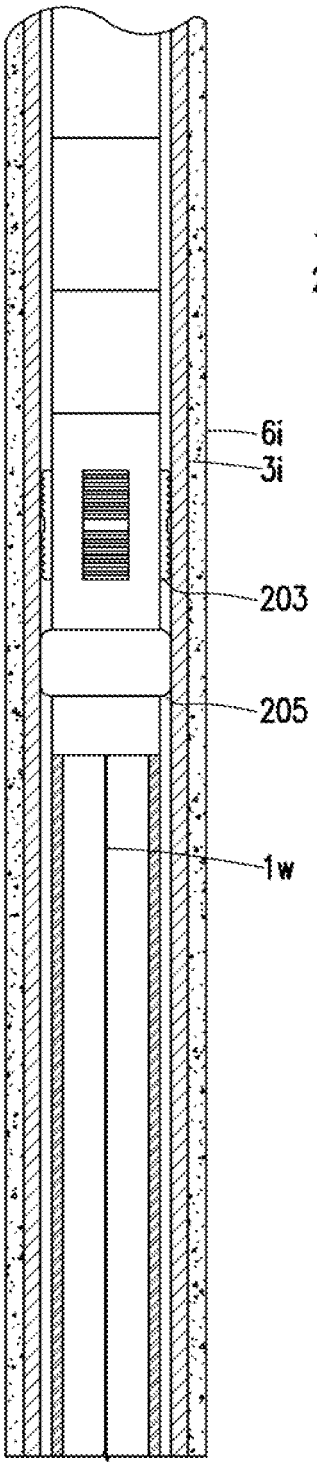
Figure 3E:
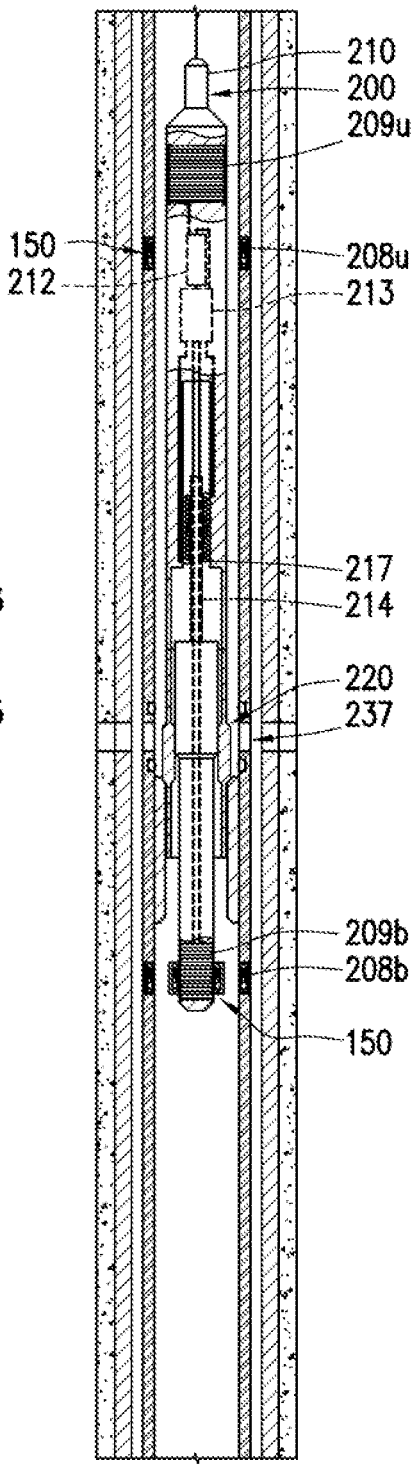
Figure 3F:
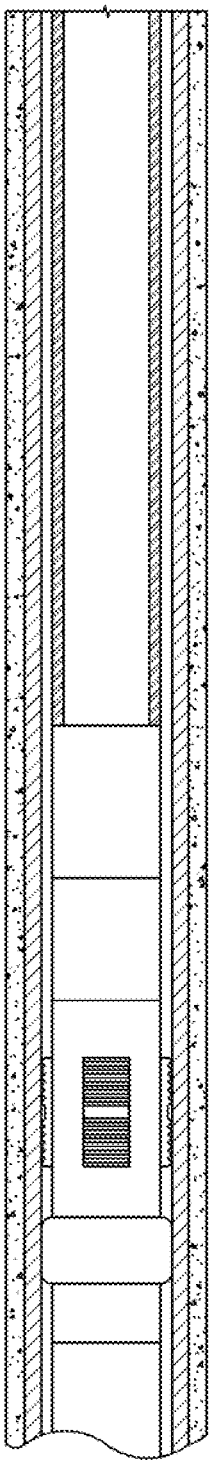
Figure 3G:
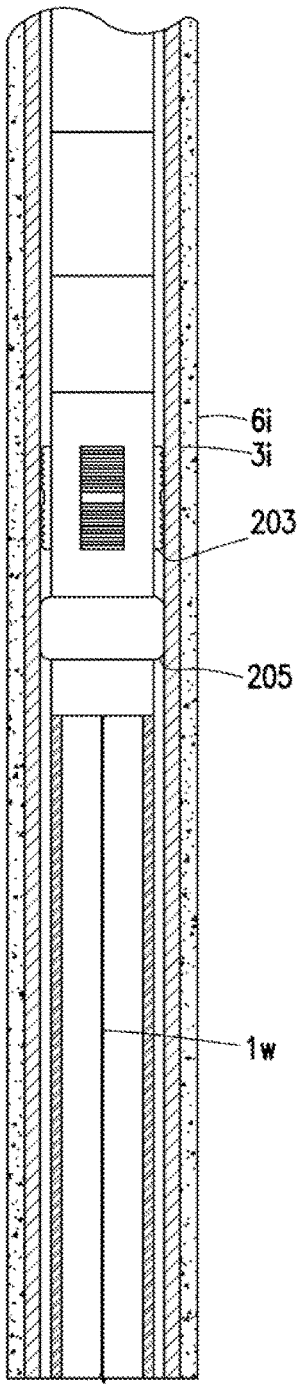
Figure 3H:
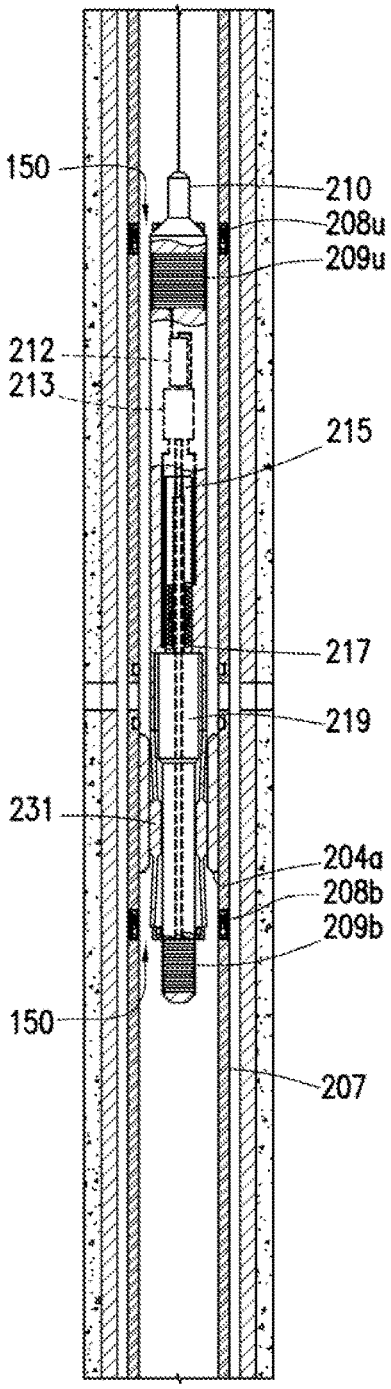
Figure 3I:
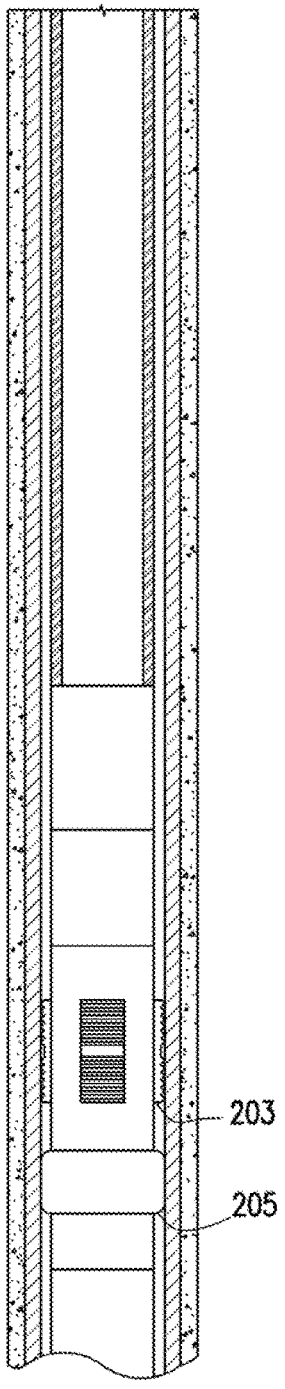
Figure 4A:
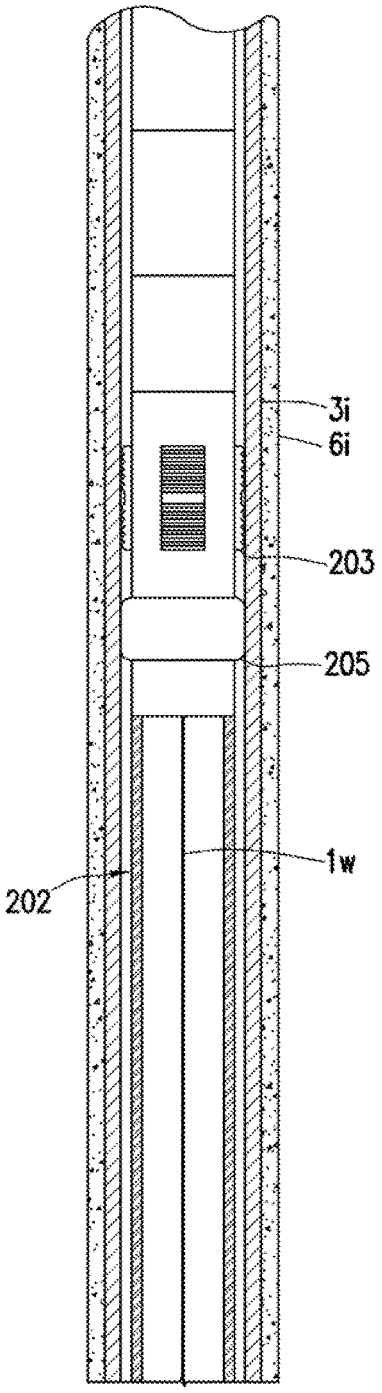
FIGS. 4A-4I illustrate the shifting tool closing the second fracture valve.
Figure 4B:
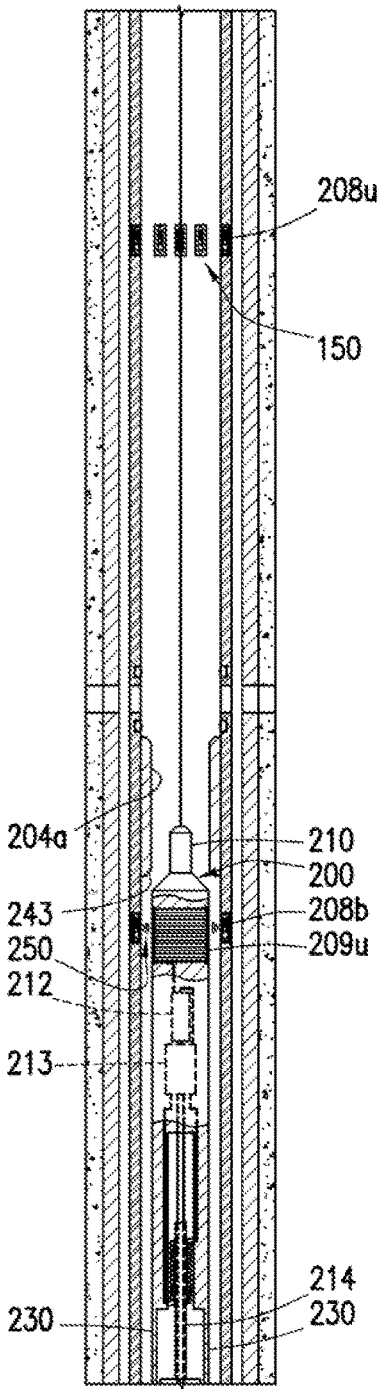
Figure 4C:
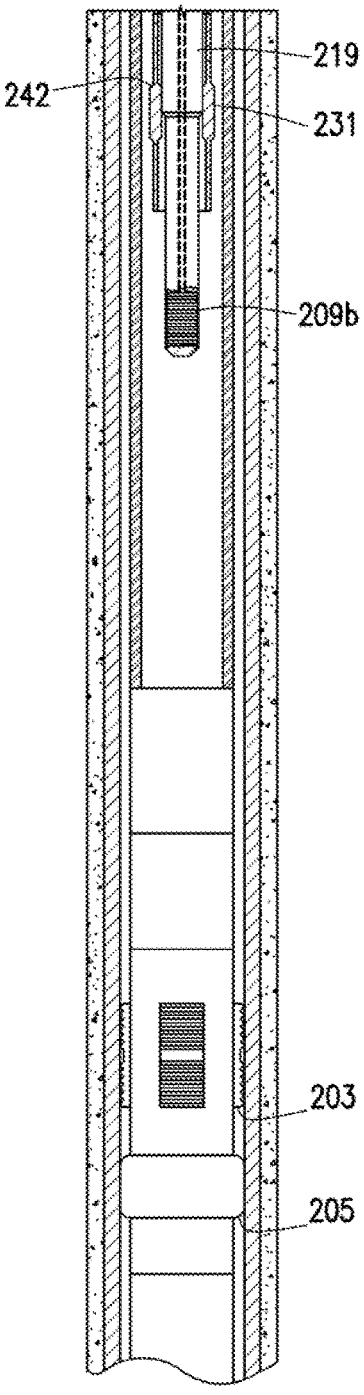
Figure 4D:
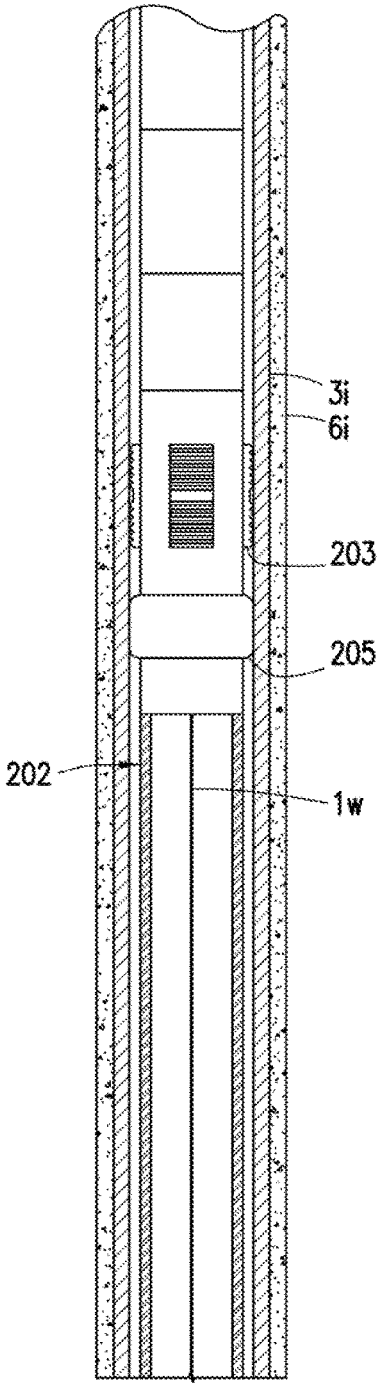
Figure 4E:
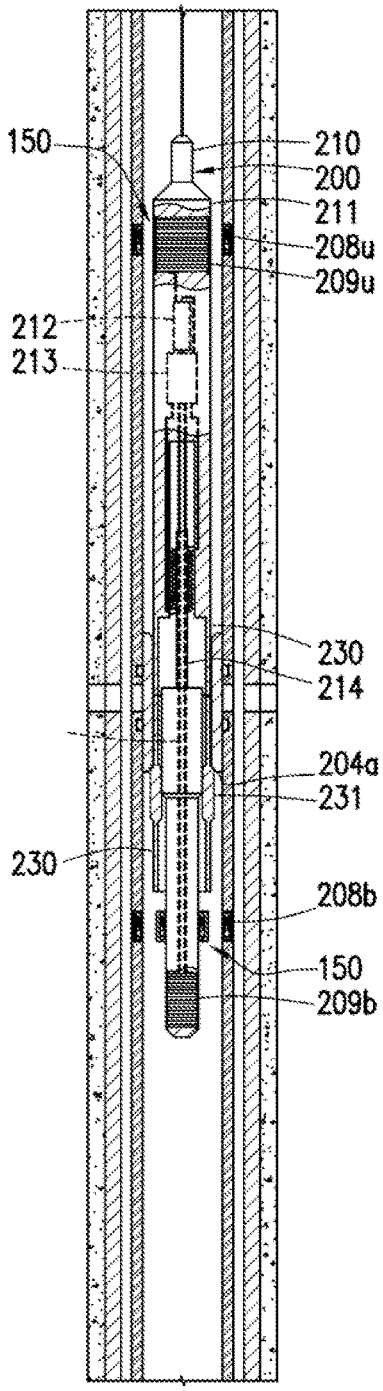
Figure 4F:
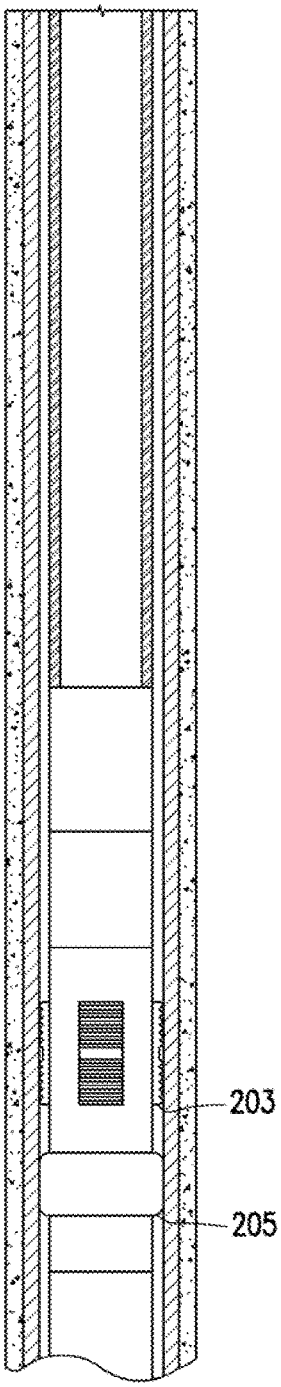
Figure 4G:
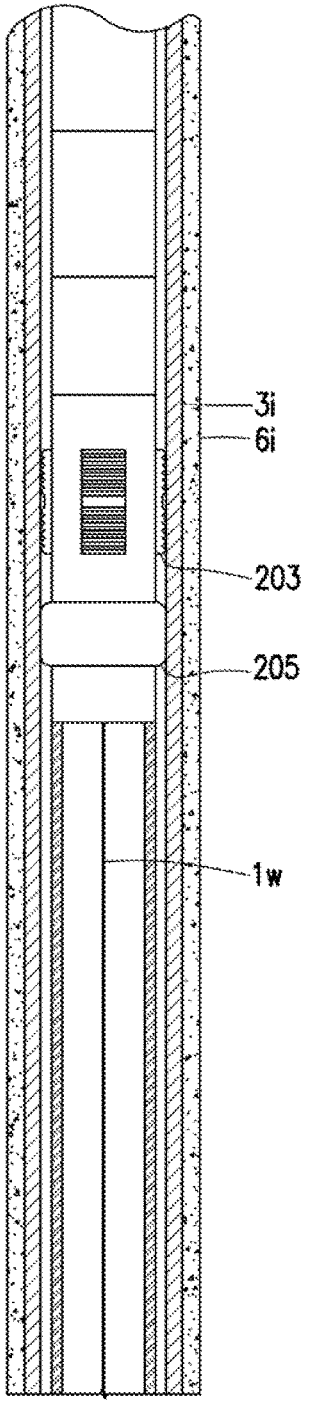
Figure 4H:
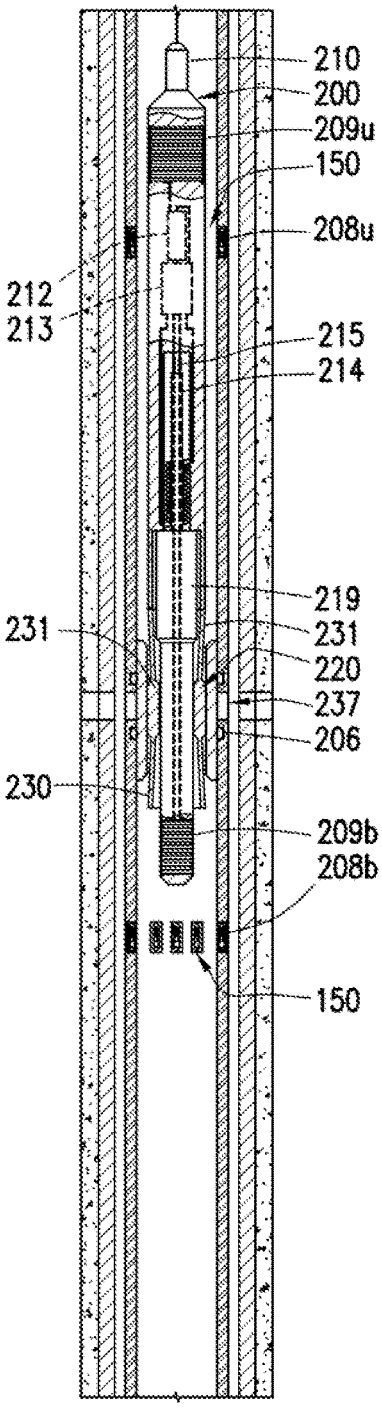
Figure 4I:
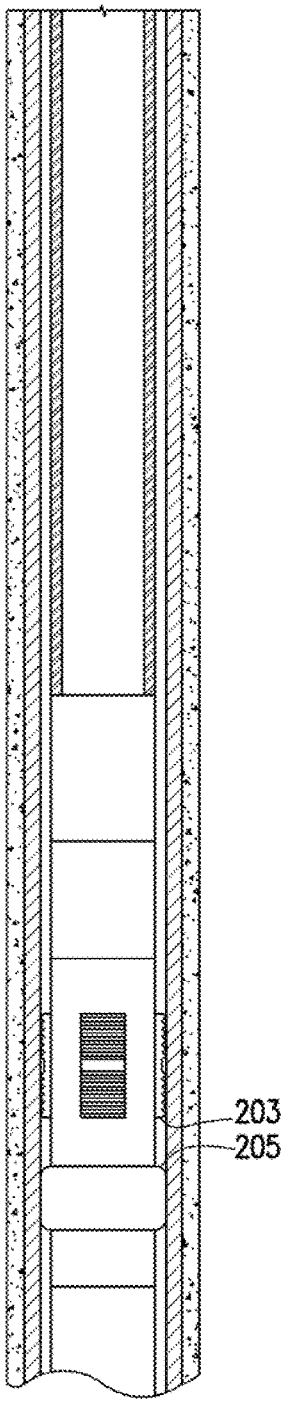
Figure 5A:
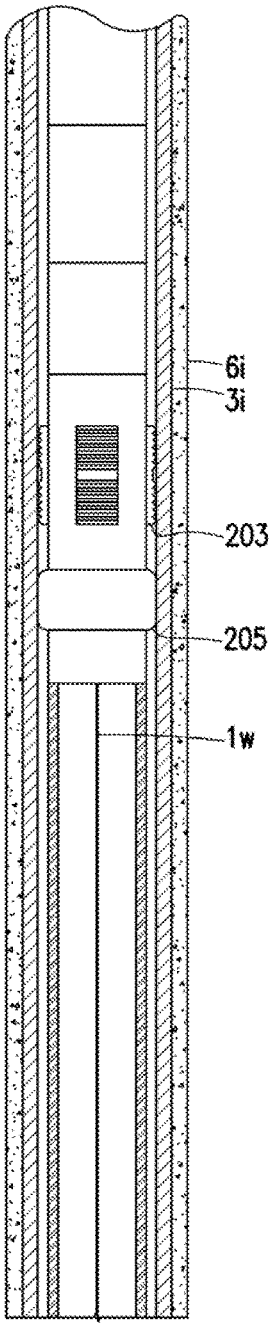
FIGS. 5A-5F illustrate the shifting tool traveling uphole through the first fracture valve in the pass-through mode.
Figure 5B:
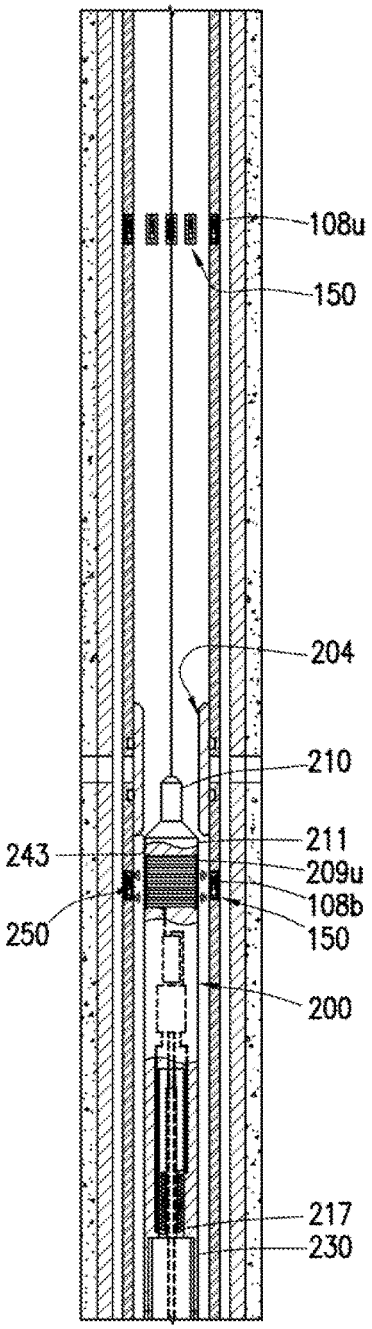
Figure 5C:
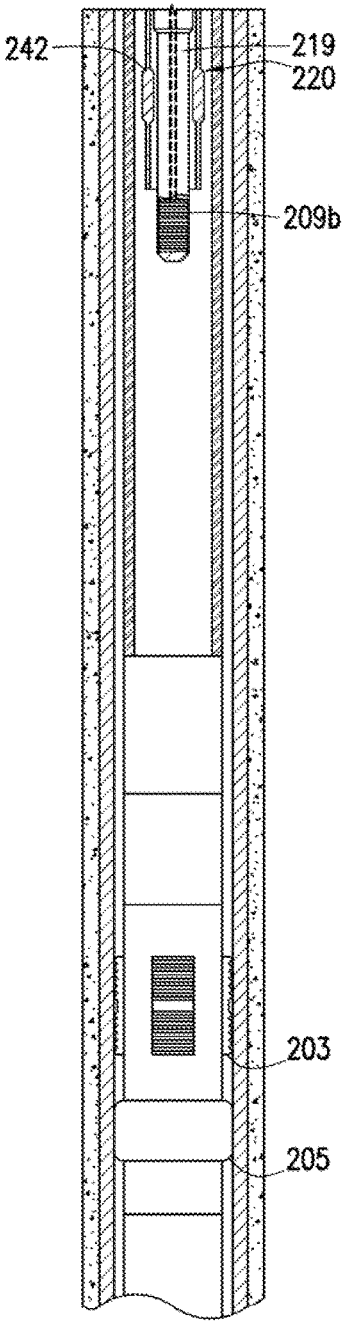
Figure 5D:
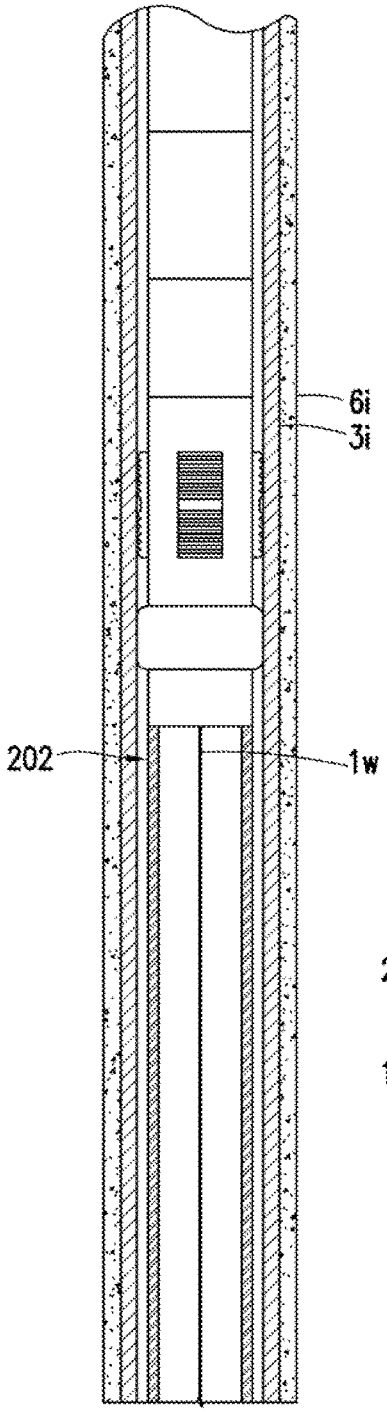
Figure 5E:
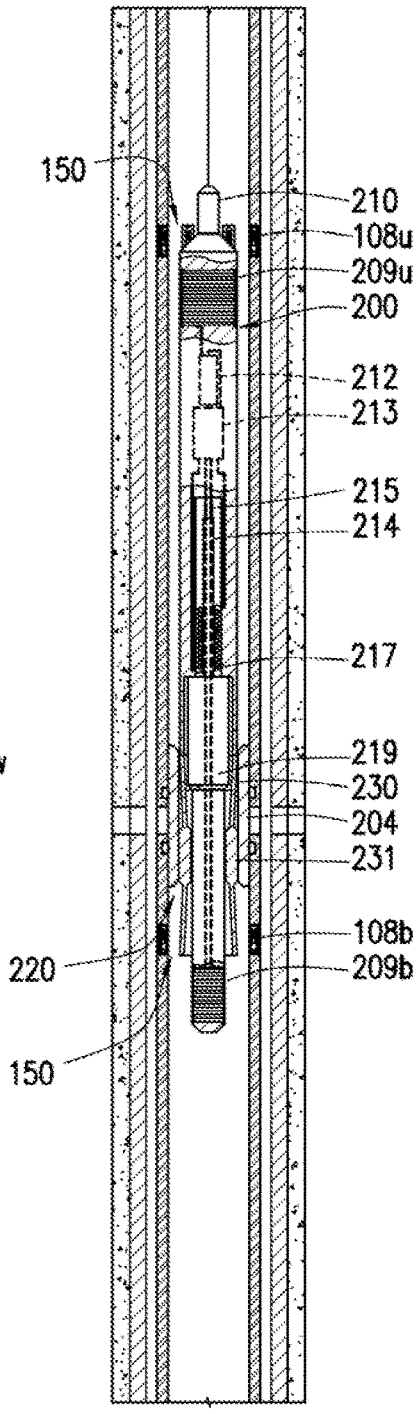
Figure 5F:
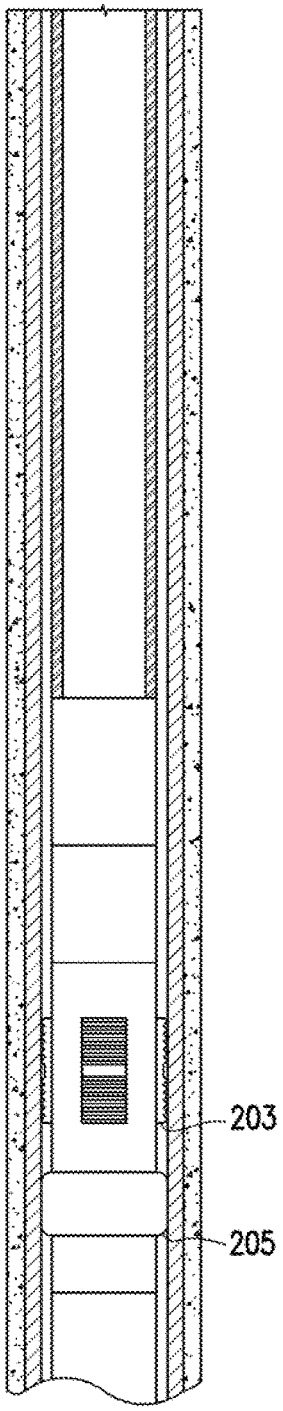

The electronics package 213 is also coupled to a magnet cylinder 214 via extendable coil wires 215, such as electrically conductive wires. The magnet cylinder 214 is disposed on a rod, upon which the magnet cylinder 214 may be actuated. Actuation of the magnet cylinder 214 is facilitated by the solenoid 217 disposed around the magnet cylinder 214. Actuation of the magnet cylinder 214 vertically actuates the collet locking mandrel 219 relative to a sleeve shifter 220 between an unlocked position (shown) and a locked position (FIGS. 3A-3C).

The sleeve shifter 220 may be a collet connected to the housing 211 and having a base portion and a plurality of split fingers 230 extending from a lower end thereof. Each of the fingers 230 may have an enlarged section 231 with one or more lower ramped surfaces 224 and one or more upper ramped surfaces 232. The collet locking mandrel 219 may extend beyond the lower end of the sleeve shifter 220 to expose the RFID antenna 209*b*, thus enhancing reception of the RFID antenna 209*b*. The collet locking mandrel 219 may include multiple portions have different diameters. A first portion of the mandrel 219 may have a diameter approximately equal to a distance between opposed enlarged portions 231, while a second portion thereof may have a diameter less than the first portion. In the unlocked position, the second portion may be adjacent to the enlarged portions 231, thereby allowing inward flexing of the fingers 230 without interference from the second portion. In the locked position, the first portion may be adjacent to the enlarged portions 231, thereby preventing inward flexing of the fingers 230. The fingers 230 may be naturally biased to an extended position to engage the sleeves 204.

Before deployment into the wellbore, the shifting tool 200 may be programmed at the surface 5*s* to selectively open and/or close one 100*b* or more of the fracture valves 100*a,b* by communicating the respective addresses of the selected valves 100*b* to the electronics package 213. As the shifting tool 200 is being lowered through the production string 202, the RFID antennas 209*a*, 209*b* transmit activation signals to and receive response signals 250 from the RFID tags when the RFID antennas 209*a*, 209*b* are moved adjacent to the RFID tags. If the RFID tag address corresponds to one of the instructed addresses, the shifting tool 200 will actuate to the locked position such that the shifter 220 will engage the sleeve 204, thereby allowing weight to be exerted thereon by slacking the work line 1*w* to open the sleeve or tension exerted thereon by pulling the work line to close the sleeve. If the RFID tag 208 does not correspond to a programmed instruction, the shifting tool 200 passes the sleeve 204 without actuating the sleeve 204.

As shown in FIGS. 2A-2F, the signal 250 received from the RFID tags of the first fracture valve 100*a* does not correspond to one of the instructed valves. Therefore, the shifting tool 200 traverses the sleeve 204 without actuating the sleeve. Traversal of the sleeve 204 without actuation is facilitated by the collet locking mandrel 219 remaining in the unlocked position, thereby allowing the fingers 230 to flex inward as guided by complimentary ramped surfaces 224, 225 on the sleeve shifter 220 and sleeve 204, respectively.

Alternatively, the first valve 100*a* may have been opened in a previous trip of the shifting tool 200 and the shifting tool instructed to close the first valve. The electronics package 213 may determine that the shifting tool 200 is being lowered downhole by reading of the upper set 108*u* of tags by the lower antenna 209*b* upon initial detection of the first fracture valve 100*a* as opposed to reading of the lower set 108*b* of tags by the upper antenna 209*u* upon initial detection of the first fracture valve 100*a* which would indicate that the shifting tool is being pulled uphole. The shifting tool 200 may remain in the pass through mode in response to the determination.

FIGS. 3A-3I illustrate the shifting tool 200 opening the second fracture valve 100*b*. Once the lower antenna 209*b* detects the upper set 208*u* of tags of the second valve 100*b*, the electronics package 213 actuates the collet locking mandrel 219 downward to a position between the enlarged sections, thereby locking the shifter 220. The collet locking mandrel 219 has a ramped surface 235 on a lower portion thereof for guiding the collet locking mandrel 219 between the enlarged portions 231. The collet locking mandrel 219 wedges between the enlarged portions 231, preventing inward flexing of the sleeve shifter 220 as the sleeve shifter 220 contacts the ramped surface 225 of the sleeve 204*a*.

With the shifting tool 200 now locked, further lowering thereof into engagement with the sleeve 204*a* allows weight to be exerted thereon because the collet locking mandrel 219 prohibits inward flexing of the enlarged portions 231. Exerting weight on the sleeve opens the second valve 100*b*. As the sleeve 204*a* reaches the open position, the lower antenna 209*b* may move into detection range of the lower set 208*b* of tags, thereby allowing the electronics package 213 to confirm opening of the second valve 100*b*. The electronics package 213 may then move the collet locking mandrel 219 to the unlocked position, thereby allowing the enlarged portions 231 to flex inward and release the sleeve 204*a*. The shifting tool 200 may then continue downhole travel past the second valve 100*b*.

After selectively opening desired valves 100*b* within the production valve string 202, the shifting tool 200 is lowered downward and parked at the bottom of the wellbore 4. With the shifting tool 200 parked, the zones exposed to the production valve string 202 by the open valves 100*b* may be fractured. After fracturing the zones, the shifting tool 200 may begin an uphole trip to the surface 5*s* and close the selected valves 100*b*.

Alternatively, the shifting tool 200 may be retrieved to the surface 5*s* before and during the fracturing operation.

FIGS. 4A-4I illustrate the shifting tool 200 closing the second fracture valve 100*b*. As the shifting tool 200 travels uphole, the upper antenna 209*u* may read a signal 250 of the lower set 208*b* of tags and the electronics package 213 may determine that the shifting tool is traveling uphole and lock the shifter 220. Continued upward travel of the shifting tool 200 may engage ramped surfaces 242 of the enlarged portions 231 with the ramped surface 243 of the sleeve 204*a*. Because the collet locking mandrel 219 prevents inward flexing of the fingers 230, tension exerted on the work line 1*w* may pull the sleeve 204 to the closed position. As the sleeve 204*a* reaches the closed position, the upper antenna 209*u* may move into detection range of the upper set 208*u* of tags, thereby allowing the electronics package 213 to confirm closing of the second valve 100*b*. The electronics package 213 may then move the collet locking mandrel 219 to the unlocked position, thereby allowing the enlarged portions 231 to flex inward and release the sleeve 204*a*. The shifting tool 200 may then continue uphole travel past the second valve 100*b*.

FIGS. 5A-5F illustrate the shifting tool traveling uphole through the first fracture valve 100*a* in the pass-through mode. As the shifting tool 200 continues the uphole travel, the upper antenna 209*u* may read a signal 250 the lower set

108*b* of tags and the electronics package 213 may determine the first fracture valve 100*a* does not correspond to one of the instructed valves 100*b*. Therefore, the shifting tool 200 traverses the sleeve 204 without actuating the sleeve. Traversal of the sleeve 204 without actuation is facilitated by the collet locking mandrel 219 remaining in the unlocked position, thereby allowing the fingers 230 to flex inward as upper ramps 242 of the enlarged portions 231 are brought into contact with the lower ramps 243 of the sleeve 204. After the enlarged portions 231 have traversed the sleeve 204, the sleeve fingers 230 may return to the extended position.

Alternatively, the shifting tool 200 may have been instructed to only open the first valve 100*a*. The shifting tool 200 may have opened the first valve 100*a* on the downhole trip but may remain in the pass through mode during the uphole trip.

Once the shifting tool 200 has returned to surface 5*s*, the shifting tool may be reprogrammed to open and/or close one or more additional fracture valves for a second fracturing operation. This process may be repeated until all the zones have been fractured. Once the fracturing operation of all the production zones has been completed, the lubricator 1*b* and injector head 10 may be removed from the tree 1*p*. The flow cross 9 may be connected to a disposal pit or tank (not shown) and fracturing fluid allowed to flow from the wellbore 4 to the pit. A production choke (not shown) may be connected to the flow cross 9 and to a separation, treatment, and storage facility (not shown). Production of the fractured zones 7 may then commence.

Alternatively, the production valve string may have a polished bore receptacle located at an upper end thereof and a tie-back production tubing string may be stabbed into the receptacle and hung from the wellhead to facilitate production. Alternatively, the production valve string 202 may extend to and be hung from the wellhead.

Alternatively, the production valve string may have a multitude of fracture valves, such as greater than or equal to five, ten, fifteen, or twenty and any number may be selected for opening and/or closing. Alternatively, the fracture valves 100*a,b* may be assembled as part of the inner casing string 3*i* and cemented into the wellbore therewith.

Alternatively, the inner casing string may be omitted and the fracture valves assembled as part of a liner string may be hung from the outer casing string and cemented into the wellbore. In a further variant of this alternative, the liner string may have open hole packers for isolating the zones instead of being cemented into the wellbore.

Alternatively, the inner casing string may have been previously installed, perforated, and fractured using a zone by zone plug and perforation system (e.g., setting a plug, perforating, fracturing, setting a second plug above the perforations, perforating again, fracturing again, and repeating until all zones have been fractured). The plugs may have then been milled out and the lower formation produced until substantial decline. The production valve string may then have been installed for a remedial fracturing operation to refracture the zones for improved production rate.

Alternatively, the electronics package may be in electrical communication with the work line and the production valve string. The production valve string may be in electrical communication with the inner casing string such that the work line may be one conductor of a telemetry circuit and the valve string and inner casing string may be a second conductor of a telemetry circuit. The shifting tool may then be reprogrammed without surface retrieval by sending instructions via the telemetry circuit.

Alternatively, the shifting tool may be reprogrammed without surface retrieval using a slip ring having one or more RFID tags encoded with new instructions for the shifting tool. The slip ring may be encoded with the new instructions and engaged with the work line at surface. The slip ring may be released and slide down the work line until the slip ring is stopped by engagement with the rope socket. The slip ring may then be in detection range of the upper antenna. The upper antenna may then read the RFID tags embedded in the slip ring, thereby communicating the new instructions to the electronics package.

Alternatively, the electronics package electronics, an RFID antenna, and an actuator may be disposed in the valve sleeve itself. In such an embodiment, a RFID tag preprogrammed with one or more valves to be shifted may be disposed down hole. As the RFID tag passes an RFID antenna disposed in the valve string, the antenna receives data from the RFID tag. If the data indicates that the sleeve corresponding to the receiving antenna is to be shifted, the actuator actuates the sleeve. To power the system, thermopiles can be used to charge a capacitor and/or batteries positioned in the valve sleeve, or power directly from the shifting tool itself may be utilized (e.g. induction current).

Figure 6:
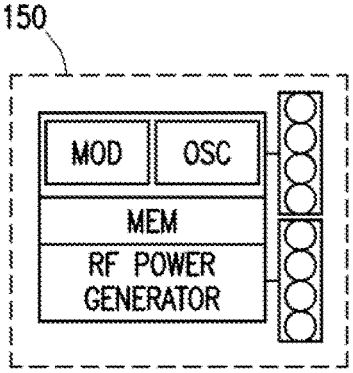
FIG. 6 illustrates an RFID tag of the fracture valves.

FIG. 6 illustrates an RFID 150 tag of the fracture valves 100*a,b*. The RFID tag 150 may be a passive tag and include an electronics package and one or more antennas housed in an encapsulation. The electronics package may include a memory unit, a transmitter, and a radio frequency (RF) power generator for operating the transmitter. The RFID tag 150 may be programmed with information indicating sleeve identification and tag position. The RFID tag 150 may be operable to transmit a wireless command signal, such as a digital electromagnetic command signal, to the antennas 209*u*, 209*b* in response to receiving the activation signal therefrom.

Figure 7A:
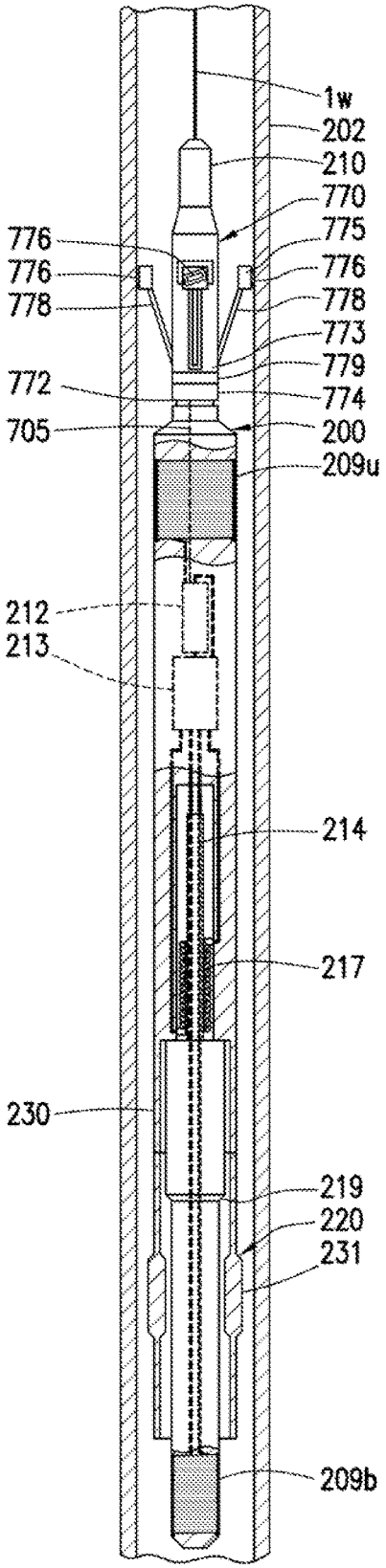
FIGS. 7A illustrates a shifting assembly having the shifting tool and a wellbore tractor, according to another embodiment of the present invention.
Figure 7B:
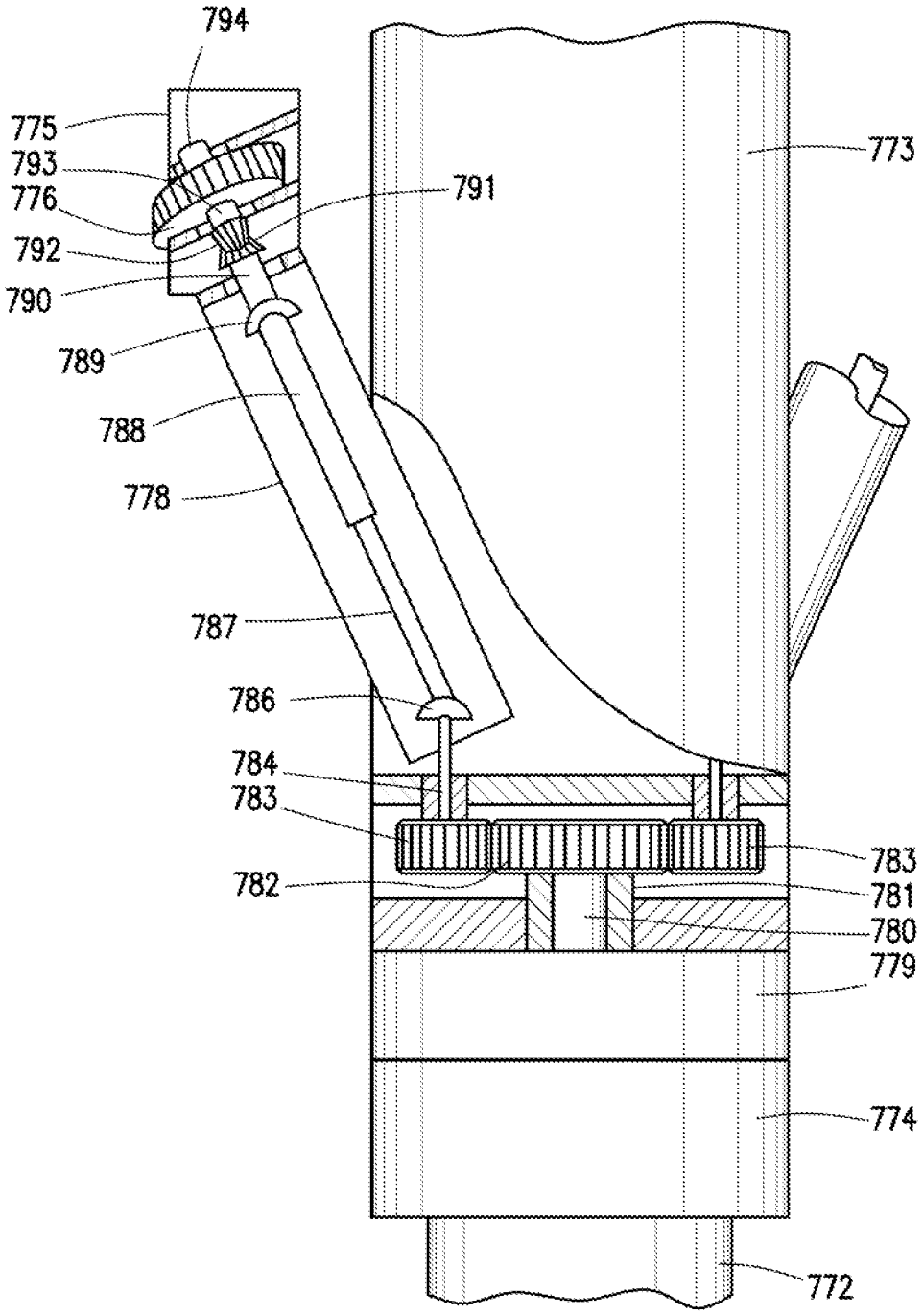
FIG. 7B illustrates the tractor.

FIG. 7A illustrates a shifting assembly 700 having the shifting tool 200 and a wellbore tractor 770, according to another embodiment of the present invention. FIG. 7B illustrates the tractor 770. The tractor 770 may be utilized to propel the shifting tool 200 through a wellbore, such as a deviated or horizontal wellbore. The assembly 700 is shown suspended in the production valve string 202 by the work line 1*w*. A swivel joint 772 couples the tractor 770 with the shifting tool 200. Wires 705 may connect an arm position unit 774 and a motor 779 with the electronics package 213. The wires 705 may include brushes, slip rings, or inductive couplings for accommodating passage through the swivel joint 772. The arm position unit 774 may be electrically operated. The lower housing portion 773 includes a plurality of pad members 775, each of which houses a toothed wheel or gear 776 and is pivotally coupled to the housing 773 by arms 778.

The housing 773 encloses the arm position drive unit 774 and an electric motor and transmission assembly 779. A drive shaft 780 extends from the assembly 779 passing through a bearing 781 and is end-fitted with a spur gear 782. Spur gear 782 is in mesh with a plurality of other spur gears 783, one for each arm unit. Each second spur gear 783 is affixed to a shaft 784 passing through a bearing 785 and terminating at a flexible coupling such as a U-joint 786. The U-joint 786 couples the drive shaft 784 to a shaft 787 located within the arm 778. Shaft 787 is adapted with a slidable spline joint 788 allowing arm 778 to be extended and retracted. The lower extremity of shaft 787 is fitted with a second U-joint 789 connected to shaft 790 fitted with a bevel gear 791. Bevel gear 791 is in mesh with a second bevel gear 792 connected to toothed wheel or gear 776 held in place within pad member 775 by bearings protruding beyond the face of the pad member 775. Gears 791 and 792 provide the rotational drive to wheel 776 and by the use of bevel gears allow angular mounting.

During operation, the shifting assembly 700 is lowered into the production valve string 202 by the work line 1*w*. When the assembly 700 enters a highly deviated portion of the borehole the force of gravity will no longer be sufficient to cause descent of the assembly and it will come to rest upon the lower borehole wall. The electronics package 213 may include a gravimeter for operating the tractor 770 in response to the deviation from vertical or the production valve string 202 may include a set of RFID tags for alerting the electronics package of the impending deviation. The electronics package 213 may activate the arm position unit 774 causing the pad members 775 to be extended outwardly until the toothed wheels or gears 776 are urged into contract with the borehole wall. The outward extension of the arms 778 will cause a centralizing effect upon the lower portion of the instrument. Once the wheels 776 have been urged into intimate contact with the wall, the electronics package 213 may then operate the motor 779.

Power supplied to the motor 779 causes rotation of shaft 780 and spur gear 782 further causing rotational force to be transferred to spur gear 783 and shaft 784. U-joints 786 and 789 combine with sliding spline connection 788 to allow rotational force to be coupled by shaft 787 when the arm 778 is in an extended position. Rotation at U-joint 789 is transferred by the meshing bevel gears 791 and 792 to provide drive to the toothed wheel or gear 776 contacting the production valve string 202. The toothed wheel 776 has a rotational torque T which is supplied by the motor 779. The production valve string may further include a set of RFID tags at a lower end thereof for instructing the electronics package 213 to cease operation of the tractor 770.

While the foregoing is directed to embodiments of the present invention, other and further embodiments of the invention may be devised without departing from the basic scope thereof, and the scope thereof is determined by the claims that follow.

What is claimed is:

1. A system for fracturing a zone of a hydrocarbon bearing formation, comprising:

a valve, comprising:

a tubular housing for assembly as part of a string of tubulars and having a bore therethrough and one or more flow ports formed through a wall thereof;

one or more locator tags embedded in the housing; and a sleeve disposed in the housing and longitudinally movable relative thereto between an open position and a closed position, wherein the sleeve seals the ports from the bore in the closed position and exposes the ports to the bore in the open position; and a shifting tool for deployment through the tubular string, comprising:

a shifter movable between an extended position and a retracted position and operable to engage the valve sleeve in the extended position and pass through the valve sleeve in the retracted position;

a lock movable between a locked position and an unlocked position, the lock keeping the shifter extended in the locked position and allowing the shifter to retract in the unlocked position;

an actuator connected to the lock and operable to at least move the lock from the unlocked position to the locked position;

an antenna for detecting the locator tags;

an electronics package in communication with the antenna and the actuator for operating the actuator in response to detection of the locator tags; and a work line rope socket connected to the electronics package and the antenna.

2. The system of claim 1, wherein:

the antenna is positioned at an upper end of the shifting tool, and the shifting tool further comprises a lower antenna located at a lower end of the shifting tool.

3. The system of claim 2, wherein:

the tags are an upper set positioned above the ports, and the valve further comprises a lower set of one or more locator tags positioned below the ports.

4. The system of claim 3, wherein the sets are spaced apart by a distance corresponding to a length of the shifting tool.

5. The system of claim 3, wherein:

the tags are encoded with an address of the valve, and the tags of each set are encoded with a position of the respective set.

6. The system of claim 1, wherein the tags are radio frequency identification (RFID) tags.

7. The system of claim 1, wherein the shifting tool further comprises a battery for powering the electronics package.

8. The system of claim 1, wherein the shifter is a collet having split fingers, each finger having an enlarged portion.

9. The system of claim 8, wherein:

the enlarged portions have ramped surfaces at ends thereof, and the valve sleeve has corresponding ramped surfaces at ends thereof.

10. The system of claim 1, wherein:

the tags are encoded with an address of the valve, the system further comprises a second valve having one or more locator tags embedded in a housing thereof, the tags are encoded with a second address of the second valve, and the electronics package is programmable to operate the actuator in response to detection of one of the addresses and not operate the actuator in response to detection of the other one of the addresses.

11. The system of claim 1, further comprising a tractor for driving the shifting tool through the tubular string.

12. The system of claim 11, wherein the tractor is connectable to the electronics package for operation of the tractor by the electronics package.

13. A method for fracturing one or more zones of a hydrocarbon bearing formation, comprising:

programming a shifting tool to selectively open one or more valves of a tubular string set in the wellbore;

deploying the shifting tool through the tubular string using a work line; and during deployment:

detecting an unselected valve by the shifting tool;

passing through the unselected valve;

detecting the selected valve by the shifting tool, wherein the shifting tool actuates a lock from an unlocked position to a locked position in response to detection of the selected valve, the lock keeping a shifter of the shifting tool extended in the locked position and allowing the shifter to retract in the unlocked position; and opening the selected valve with the shifter of the locked shifting tool.

14. The method of claim 13, further comprising:

parking the shifting tool in the tubular string after opening the selected valve;

fracturing the zone adjacent to the open valve; and retrieving the shifting tool through the tubular string using the work line; and during retrieval:

detecting the selected valve by the shifting tool, wherein the shifting tool actuates to a locked position in response to detection of the selected valve;

closing the selected valve by the locked shifting tool detecting the unselected valve by the shifting tool;

passing through the unselected valve.

15. The method of claim 13, wherein the shifting tool is deployed also using a tractor.

16. The method of claim 15, wherein the tractor is operated by the shifting tool.

17. The method of claim 13, wherein the work line is slickline or wire rope.

18. The method of claim 13, wherein detecting the selected valve includes detecting locator tags with an antenna.

19. The method of claim 13, wherein the locator tags are encoded with an address of the valve.

* * * * *